US011835006B2

(12) United States Patent
Inaba et al.

(10) Patent No.: US 11,835,006 B2
(45) Date of Patent: Dec. 5, 2023

(54) FUEL INJECTION CONTROL DEVICE

(71) Applicant: DENSO CORPORATION, Kariya (JP)

(72) Inventors: Masashi Inaba, Kariya (JP); Tomoki Fujino, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 17/676,938

(22) Filed: Feb. 22, 2022

(65) Prior Publication Data

US 2022/0275765 A1 Sep. 1, 2022

(30) Foreign Application Priority Data

Feb. 26, 2021 (JP) ..... 2021-030871

(51) Int. Cl.

*F02D 41/20* (2006.01)
*F02D 41/22* (2006.01)
*F02D 41/28* (2006.01)
*F02D 41/40* (2006.01)

(52) U.S. Cl.

CPC ..... *F02D 41/20* (2013.01); *F02D 41/221* (2013.01); *F02D 41/28* (2013.01); *F02D 41/401* (2013.01); *F02D 2041/2003* (2013.01); *F02D 2041/224* (2013.01); *F02D 2041/288* (2013.01)

(58) Field of Classification Search

CPC ..... F02D 41/00; F02D 41/0085; F02D 41/04; F02D 41/042; F02D 41/20; F02D 41/221; F02D 41/228; F02D 41/401; F02D 2200/063; F02D 2041/2003; F02D 2041/2037; F02D 2041/2055; F02D 2041/2058; F02D 2041/2079; F02M 51/06; F02M 51/061; F02M 51/0685; F02M 65/00; F02M 65/005; F02M 2200/245

See application file for complete search history.

(56) References Cited

U.S. PATENT DOCUMENTS 5,992,391 A * 11/1999 Yamakado ..... F02M 51/0621 361/147
9,835,108 B2 * 12/2017 Nishimura ..... F02D 41/20
2002/0177237 A1 * 11/2002 Shvets ..... F16K 37/005 436/180
2004/0118384 A1 * 6/2004 Oyama ..... F02D 41/3082 123/479

(Continued)

*Primary Examiner* — John Kwon
*Assistant Examiner* — Johnny H Hoang
(74) *Attorney, Agent, or Firm* — POSZ LAW GROUP, PLC

(57) ABSTRACT

An energization control unit is configured to perform a constant current control by repeatedly switching between an on-state and an off-state of at least one upstream switch provided in an energization path of a coil of a fuel injection valve to control opening of the fuel injection valve in a drive period in which the coil is energized to drive the fuel injection valve. A current detection unit is configured to detect a coil current flowing through the coil. A valve-opening detection unit is configured to detect valve-opening timing of the fuel injection valve based on a change in at least one frequency spectrum of the coil current in a constant current control period in which the constant current control is performed. A valve-opening correction unit is configured to correct valve opening of the fuel injection valve based on a detection result of the valve-opening detection unit.

22 Claims, 14 Drawing Sheets

(56) References Cited

U.S. PATENT DOCUMENTS

| | | | | |
|---|---|---|---|---|
| 2004/0181760 | A1* | 9/2004 | Ismailov | G06F 30/20 703/2 |
| 2005/0279867 | A1* | 12/2005 | Ismailov | F02M 59/366 239/585.1 |
| 2008/0261261 | A1* | 10/2008 | Grimes | G01N 33/4905 435/287.1 |
| 2009/0126692 | A1* | 5/2009 | Bolz | F02D 41/20 123/490 |
| 2009/0132180 | A1* | 5/2009 | Pearce | F02D 41/20 702/38 |
| 2009/0205413 | A1* | 8/2009 | Yamauchi | F02M 65/003 73/114.38 |
| 2014/0069389 | A1 | 3/2014 | Nishimura | |
| 2018/0156148 | A1* | 6/2018 | Nishimura | F02D 41/04 |
| 2021/0071609 | A1* | 3/2021 | Inaba | F02D 41/20 |
| 2021/0071610 | A1* | 3/2021 | Inaba | F02D 41/20 |
| 2021/0164412 | A1* | 6/2021 | Inaba | F02D 41/20 |
| 2021/0372337 | A1* | 12/2021 | Yoshikawa | F02D 41/38 |
| 2021/0404407 | A1* | 12/2021 | Shirakawa | F02D 41/40 |

* cited by examiner

FUEL INJECTION CONTROL DEVICE

CROSS REFERENCE TO RELATED APPLICATION

The present application claims the benefit of priority from Japanese Patent Application No. 2021-030871 filed on Feb. 26, 2021. The entire disclosures of all of the above applications are incorporated herein by reference.

TECHNICAL FIELD

The present disclosure relates to a fuel injection control device configured to control a fuel injection valve.

BACKGROUND

Conventionally, a configuration to specify valve-opening timing is known.

SUMMARY

According to an aspect of the present disclosure, a fuel injection control device is configured to detect a valve-opening timing of a fuel injection valve and correct a valve opening of the fuel injection valve.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereinafter, examples of the present disclosure will be described.

According to an example of the present disclosure, a configuration is employed to specify valve-opening timing by detecting an inflection point of a current waveform indicating a time change of a current flowing through a fuel injection valve.

It is noted that, as a result of detailed examination by the inventor, it has been found that the valve-opening timing may not be specified desirably by using the inflection point of the current waveform when the fuel injection valve is controlled by allowing a large current to flow through the fuel injection valve by use of a boosted voltage obtained by boosting a battery voltage of an in-vehicle battery.

In consideration of the above, a fuel injection control device according to an example is configured to control energization of a coil of a fuel injection valve. The fuel injection control device comprises an energization control unit configured to, in a drive period in which the coil is energized to drive the fuel injection valve, perform a constant current control by repeatedly switching between an on-state and an off-state of at least one upstream switch provided in an energization path to control opening of the fuel injection valve. The fuel injection control device further comprises a current detection unit configured to detect a coil current flowing through the coil. The fuel injection control device further comprises a valve-opening detection unit configured to detect valve-opening timing of the fuel injection valve based on a change in at least one frequency spectrum of the coil current in a constant current control period in which the constant current control is performed. The fuel injection control device further comprises a valve-opening correction unit configured to correct valve opening of the fuel injection valve based on a detection result of the valve-opening detection unit.

The fuel injection control device of the present disclosure configured as described above enables to detect the valve-opening timing of the fuel injection valve generated during the constant current control period when the fuel injection valve is opened by performing the constant current control by use of the boosted voltage obtained by boosting the battery voltage of the in-vehicle battery. Therefore, the fuel injection control device of the present disclosure can specify the valve-opening timing when the fuel injection valve is controlled by allowing a large current to flow.

First Embodiment

Hereinafter, a first embodiment of the present disclosure will be described with reference to the drawings.

Figure 1:
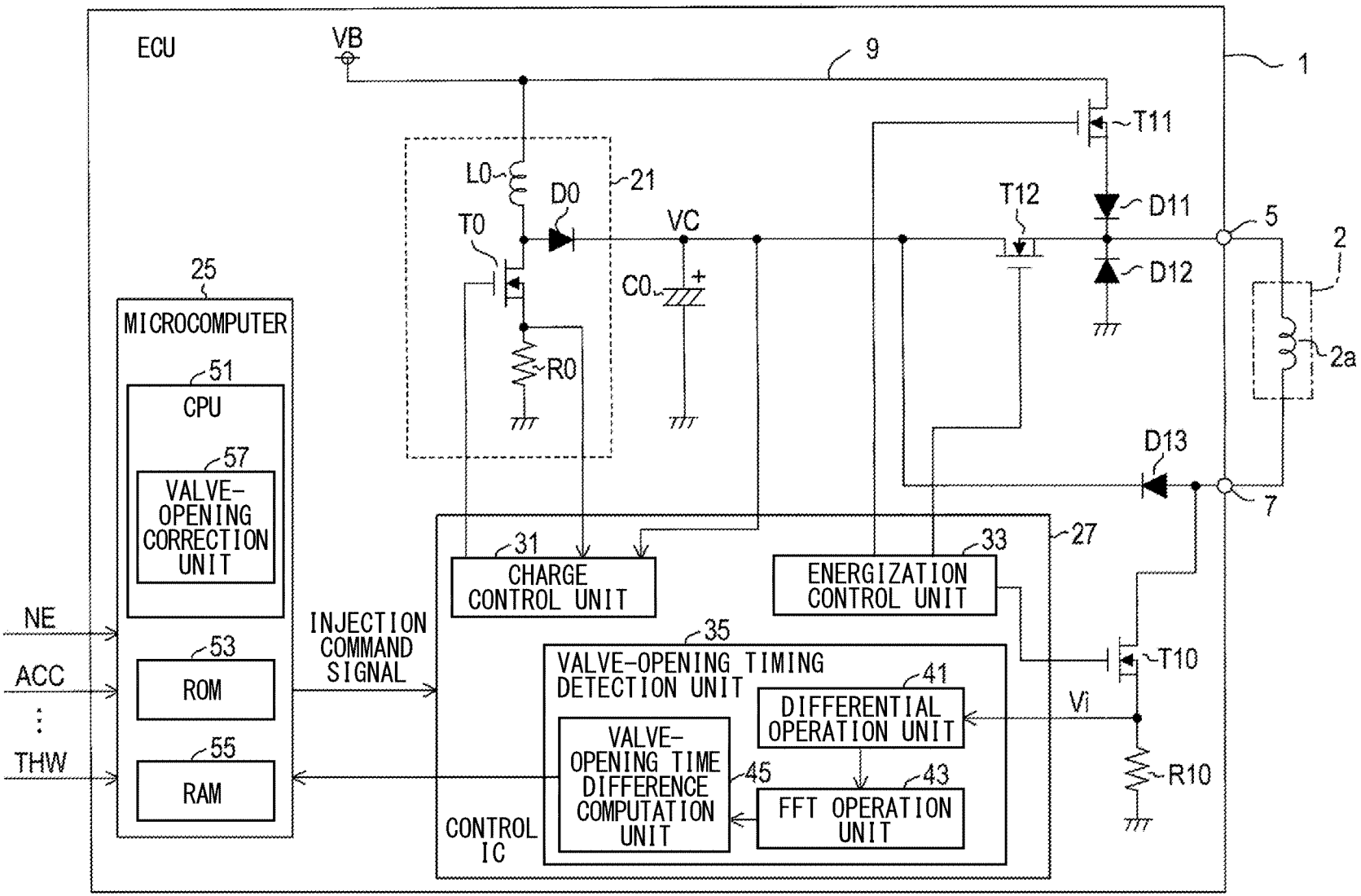
FIG. 1 is a block diagram illustrating a configuration of a fuel injection control device.

As illustrated in FIG. 1, a fuel injection control device 1 (hereinafter, ECU 1) of the present embodiment drives a plurality of fuel injection valves 2 (hereinafter, injector 2) that inject and supply fuel to respective cylinders of a plurality of cylinder engines mounted in a vehicle. ECU stands for an electronic control unit.

The ECU 1 controls the fuel injection timing and the fuel injection amount to each cylinder by controlling the energization start timing and the energization time for the coil 2*a* of each injector 2. The ECU 1 includes an upstream terminal 5 to which an upstream end of the coil 2*a* of the injector 2 is connected and a downstream terminal 7 to which a downstream end of the coil 2*a* is connected.

The ECU 1 includes a transistor T10 and a current detecting resistor R10. The transistor T10 is an n-channel metal-oxide-semiconductor field-effect transistor (MOSFET) and has a drain connected to a downstream terminal 7 and a source connected to one end of the current detecting resistor R10. The current detecting resistor R10 has one end connected to the source of the transistor T10 and the other end connected to a ground line.

When the coil 2*a* of the injector 2 is energized, a valve body (so-called nozzle needle), not illustrated, moves to a valve-opening position (i.e., the valve is opened), and fuel is injected from the injector 2. When the energization of the coil 2*a* is cut off, the valve body returns to the original valve closing position (i.e., the valve is closed), and the fuel injection is stopped.

FIG. 1 illustrates only one injector 2 among the plurality of injectors 2. The drive of the one injector 2 will be described below. In practice, the upstream terminal 5 is a common terminal for the plurality of injectors 2. The downstream terminal 7 and the transistor T10 are provided for each injector 2 (i.e., for each cylinder). The transistor T10 is a switch for selecting the injector 2 to be driven (i.e., injection target cylinder) and is also called a cylinder selection switch.

The ECU 1 includes a transistor T11, a diode D11 for preventing a back-flow, a diode D12 for current reflux, a capacitor C0 in which energy to be discharged is stored in a coil 2*a*, and a DC-to-DC converter 21 that boosts a battery voltage VB of the in-vehicle battery to charge the capacitor C0.

The transistor T11 is an n-channel MOSFET and has a drain connected to a power supply line 9, to which the battery voltage VB of the in-vehicle battery is supplied, and a source connected to the anode of the diode D11. A p-channel MOSFET may be applied to the transistor T11.

The cathode of the diode D11 is connected to the upstream terminal 5. The diode D12 has a cathode connected to the upstream terminal 5 and an anode connected to the ground line.

The DC-to-DC converter 21 includes a boosting coil L0, a transistor T0, a current detecting resistor R0, and a back-flow preventing diode D0.

The coil L0 has one end connected to the power supply line 9 and the other end connected to the anode of the diode D0 and the drain of the transistor T0. The source of the transistor T0 is connected to the ground line via the resistor R0. The capacitor C0 has one end connected to the cathode of the diode D0 and the other end connected to the ground line.

The DC-to-DC converter 21 generates a flyback voltage higher than the battery voltage VB at the connection point between the coil L0 and the transistor T0 by repeating switching between the on-state and the off-state of the transistor T0. The capacitor C0 is charged by the flyback voltage. Thus, the capacitor C0 is charged at a voltage higher than the battery voltage VB.

The ECU 1 includes a transistor T12 and a diode D13 for energy recovery. The transistor T12 is an n-channel MOSFET and has a drain connected to the positive electrode of the capacitor C0 and a source connected to the upstream terminal 5. A p-channel MOSFET may be applied to the transistor T12.

The diode D13 has an anode connected to the downstream terminal 7 and a cathode connected to the positive electrode of the capacitor C0.

The ECU 1 includes a microcomputer 25 and a control IC 27. IC stands for an integrated circuit.

The microcomputer 25 includes a central processing unit (CPU) 51, a read-only memory (ROM) 53, a read-only memory (RAM) 55, and the like. Various functions of the microcomputer 25 are achieved by the CPU 51 executing a program stored in a non-transitory tangible recording medium. In this example, the ROM 53 corresponds to a non-transitory tangible recording medium storing a program. By executing the program, a method corresponding to the program is executed. Some or all of the functions executed by the CPU 51 may be configured as hardware by one or a plurality of ICs or the like.

The CPU 51 functions as a valve-opening correction unit 57 by performing correction processing to be described later. A signal indicating an engine speed NE, a signal indicating an accelerator opening degree ACC, a signal indicating an engine cooling water temperature THW, and the like are input to the microcomputer 25. The microcomputer 25 generates an injection command signal for each cylinder based on the engine operating state specified by the input various signals and outputs the injection command signal to the control IC 27.

The injection command signal is a signal for driving the injector 2 (i.e., energizing the coil 2*a* of the injector 2) only while the level of the signal is an active level (e.g., high in the present embodiment). Therefore, the microcomputer 25 sets the drive period of the injector 2 (i.e., the energization period for the coil 2*a*) for each cylinder based on the engine operating state and sets the injection command signal of the corresponding cylinder to high only during the drive period.

Further, a signal obtained by amplifying a voltage generated across the current detecting resistor R10 by an amplifier circuit, not illustrated, is input to the control IC 27 as a current monitor signal Vi indicating a value of a current (hereinafter, coil current) flowing through the coil 2*a* of the injector 2.

The control IC 27 includes a charge control unit 31, an energization control unit 33, and a valve-opening timing detection unit 35. The charge control unit 31 controls the charging by the DC-to-DC converter 21 by controlling the transistor T0.

The energization control unit 33 controls the coil current by controlling the transistors T10, T11, T12.

Next, the operation of the energization control unit 33 will be described.

Figure 2:
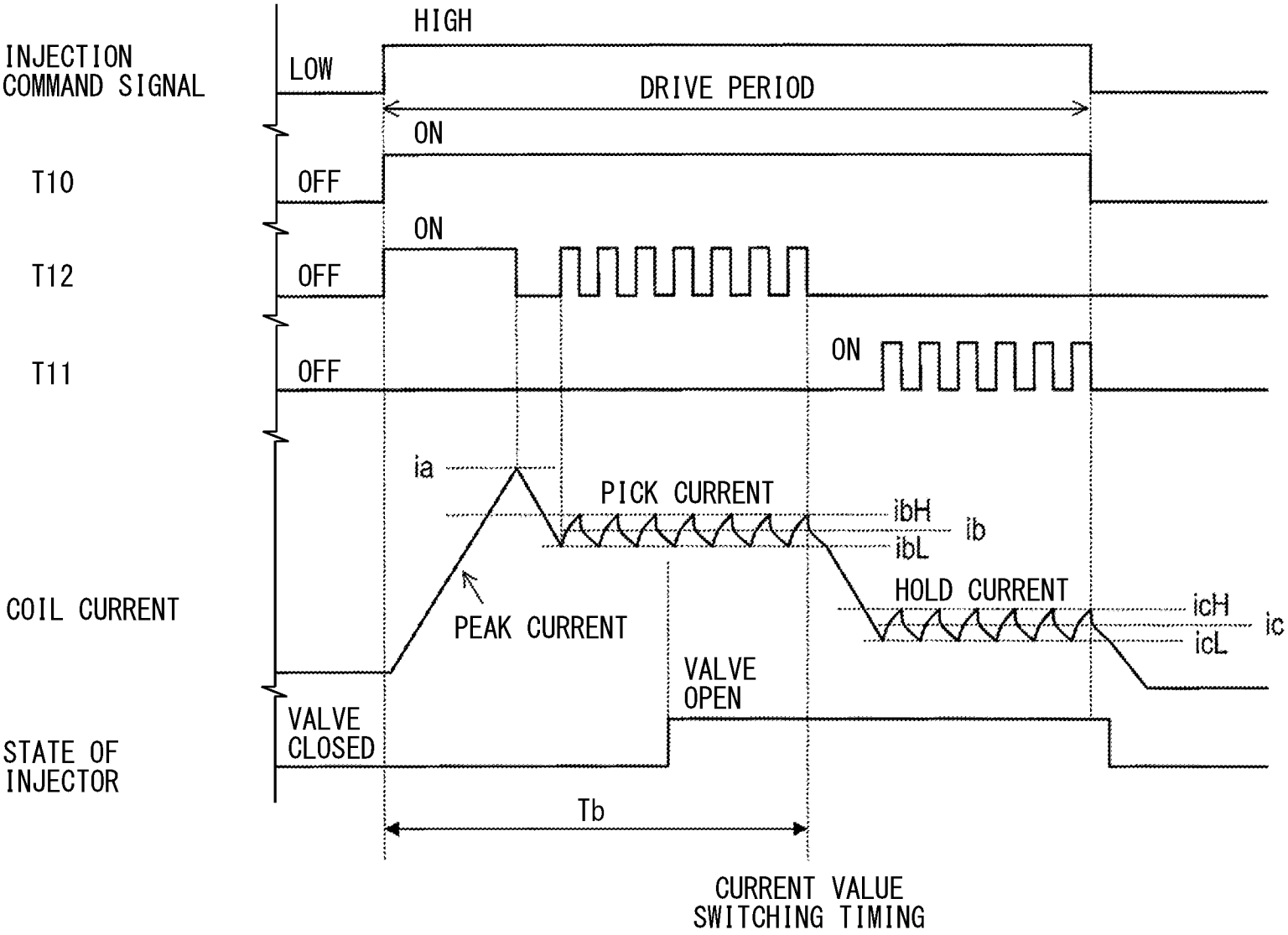
FIG. 2 is a timing chart illustrating a method of controlling a coil current.

As illustrated in FIG. 2, when the injection command signal of the injection target cylinder becomes high, the energization control unit 33 turns on the transistor T10 corresponding to the injector 2 of the injection target cylinder while the injection command signal is high.

When the injection command signal becomes high, the energization control unit 33 turns on the transistor T12. As a result, the positive electrode of the capacitor C0 is connected to the upstream terminal 5, and discharge is performed from the capacitor C0 to the coil 2*a*. By this discharge, the energization of the coil 2*a* is started.

The energization control unit 33 detects a value of the coil current (hereinafter, coil current value) based on the current monitor signal Vi. After turning on the transistor T12, when detecting that the coil current value reaches a target peak value ia (e.g., 12 A), the energization control unit 33 turns off the transistor T12.

In this manner, at the start of the energization of the coil 2*a*, the energy accumulated in the capacitor C0 is released to the coil 2*a*. This discharge current is a current (hereinafter, peak current) for increasing the valve opening speed of the injector 2.

After turning off the transistor T12, the energization control unit 33 performs constant current control of repeatedly switching the on-state and the off-state of the transistor T12 or the transistor T11 so that the coil current becomes a constant current smaller than the target peak value ia.

Specifically, the energization control unit 33 performs the following first constant current control during a period from when the injection command signal becomes high (i.e., at the start of the drive period) to when a certain time Tb elapses. The first constant current control is control to turn on the transistor T12 when detecting that the coil current value is equal to or smaller than a first lower threshold value ibL, and to turn off the transistor T12 when detecting that the coil current value is equal to or larger than a first upper threshold value ibH.

The energization control unit 33 performs the following second constant current control during a period from the time point when the time Tb has elapsed until the injection command signal becomes low (i.e., until the end of the drive period). The second constant current control is control to turn on the transistor T11 when detecting that the coil current value is less than or equal to a second lower threshold icL, and to turn off the transistor T11 when detecting that the coil current value is larger than or equal to a second upper threshold icH.

A magnitude relationship among the first and second lower threshold values ibL, icL the first and second upper threshold values ibH, icH, and the target peak value ia is ia≥ibH>ibL>icH>icL.

Therefore, as illustrated in FIG. 2, when the coil current value decreases from the target peak value ia to be equal to or less than the first lower threshold value ibL, the switching between the on-state and the off-state of the transistor T12 is repeated by the first constant current control, and the average value of the coil current is maintained at a first constant value ib, which is a current value between ibH and ibL.

When the time Tb elapses from the start of the drive period, the first constant current control is switched to the second constant current control. The timing of switching from the first constant current control to the second constant current control is referred to as a current value switching timing.

Thus, from the current value switching timing to the end of the drive period, the switching between the on-state and the off-state of the transistor T11 is repeated by the second constant current control, and the average value of the coil current is maintained at a second constant value ic which is the current value between icH and icL.

As described above, the energization control unit 33 switches the drive current after the end of the discharge from the capacitor C0 to the coil 2*a* into two stages of a current with its average value being the first constant value ib and a current with its average value being the second constant value ic smaller than the first constant value ib.

In the period from the end of the discharge to the arrival of the current value switching timing, the current allowed to flow through the coil 2*a* (i.e., the current with its average value being the first constant value ib) is a pickup current (hereinafter, pick current) for completing the valve opening of the injector 2. As illustrated in the lowermost stage in FIG. 2, the injector 2 is opened (i.e., transits from the valve closed state to the valve open state) during a period when a pick current is allowed to flow through the coil 2*a*.

In the period from the current value switching timing to the end of the drive period, the current allowed to flow through the coil 2*a* (i.e., the current with its average value being the second constant value ic) is a hold current for holding the valve open state of the injector 2. The hold current is smaller than the pick current since being the minimum current required to hold the valve open state of the injector 2.

When the transistor T11 is in the on-state, a current flows from the power supply line 9 side to the coil 2*a* via the transistor T11 and the diode D11, and when the transistor T11 is in the off-state, a current flows back from the ground line side via the diode D12.

When the injection command signal from the microcomputer 25 changes from high to low, the energization control unit 33 turns off the transistor T10, finishes switching between the on-state and the off-state of the transistor T11, and also holds the transistor T11 in the off-state.

As a result, the energization of the coil 2*a* is stopped, the injector 2 is closed, and the fuel injection by the injector 2 is terminated. When the injection command signal becomes low, and both the transistor T10 and the transistor T11 are turned off, flyback energy is generated in the coil 2*a*, but this flyback energy is recovered in the form of a current to the capacitor C0 through the diode D13 forming the energy recovery path.

As illustrated in FIG. 1, the valve-opening timing detection unit 35 includes a differential operation unit 41, an FFT operation unit 43, and a valve-opening time difference computation unit 45. FFT stands for fast Fourier transform.

The differential operation unit 41 computes a value (hereinafter, time differential value (di/dt)) obtained by time-differentiating the coil current value in the period from when the injection command signal becomes high to when the signal becomes low (i.e., drive period) at every preset differential operation time (e.g., 10 μs).

The FFT operation unit 43 performs an FFT operation on the time differential value (di/dt) computed by the differential operation unit 41 at every preset FFT operation time (e.g., 200 μs) to create a frequency spectrum.

The valve-opening time difference computation unit 45 computes a difference (hereinafter, valve-opening time difference) between the valve-opening timing (hereinafter, estimated valve-opening timing) estimated from the timing at which the injection command signal becomes high and the valve-opening timing (hereinafter, detected valve-opening timing) detected based on the time change of the frequency spectrum created by the FFT operation unit 43. The valve-opening time difference computation unit 45 outputs, to the microcomputer 25, the computed valve-opening time difference or valve-opening detection information indicating that the valve-opening time difference has failed to be computed.

Figure 3:
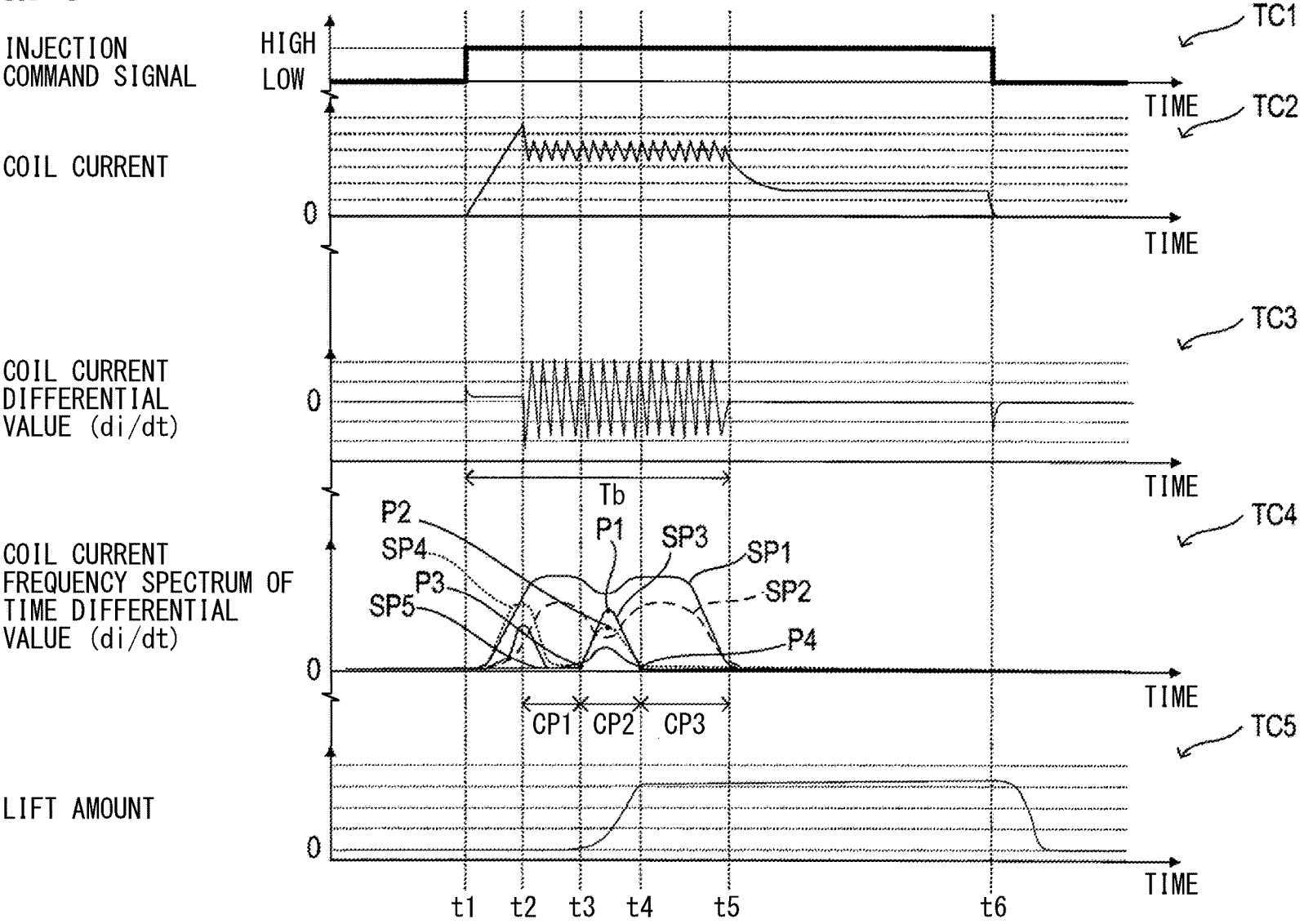
FIG. 3 is a timing chart illustrating a method for detecting a valve-opening timing.

A timing chart TC1 of FIG. 3 illustrates a time change of the injection command signal. A timing chart TC2 of FIG. 3 illustrates a time change of the coil current. A timing chart TC3 of FIG. 3 illustrates a time change of the time differential value (di/dt). A timing chart TC4 of FIG. 3 illustrates a time change of the frequency spectrum of the time differential value (di/dt). A timing chart TC5 of FIG. 3 illustrates a time change of a lift amount of a nozzle needle in the injector 2.

As illustrated in FIG. 3, when the injection command signal switches from low to high at time t1, a peak current in which a current value rapidly increases flows through the injector 2.

As illustrated in the timing chart TC2, when the coil current reaches the target peak value is at time t2, a pick current in which a current value oscillates between the first upper threshold value ibH and the first lower threshold value ibL flows through the injector 2 during a period from when the first constant current control is started until time Tb elapses from time t2.

As illustrated in the timing chart TC3, the time differential value (di/dt) also oscillates in response to the vibration of the pick current value.

As illustrated in the timing chart TC5, the valve opening of the injector 2 is started at time t3 in the period when the pick current is flowing, and the valve opening of the injector 2 is completed at time t4.

Further, as illustrated in the timing chart TC2, at time t5 when time Tb has elapsed from time t1, the first constant current control is switched to the second constant current control, and a hold current in which the current value oscillates between the second upper threshold icH and the second lower threshold icL flows through the injector 2.

When the injection command signal is switched from high to low at time t6, the coil current becomes 0 A as illustrated in the timing chart TC2. Thereby, as illustrated in the timing chart TC5, the injector 2 transitions from the valve open state to the valve closed state.

As illustrated in the timing chart TC4, in a period CP1 from time t2 to time t3, the intensity of a frequency spectrum SP1 and the intensity of a frequency spectrum SP2 are large.

In a period CP2 from time t3 to time t4, the intensities of the frequency spectra SP1, SP2 decrease, and the intensity of a frequency spectrum SP3 and the intensity of a frequency spectrum SP4 increase. A frequency (in the present embodiment, about 25 kHz is assumed) is set for repeatedly switching the transistors T11, T12 between the on-state and the off-state when the valve-opening timing is detected. Hereinafter, the above frequency is referred to as a valve-opening detection switching frequency.

Further, in a period CP3 from time t4 to time t5, the intensities of the frequency spectra SP1, SP2 increase, and the intensities of the frequency spectra SP3, SP4 decrease.

The frequency spectrum SP5 has a small change in intensity in the periods CP1, CP2, CP3.

The intensity of the frequency spectrum SP3 and the intensity of the frequency spectrum SP4 are small in the periods CP1, CP3 and large in the period CP2.

Therefore, the valve-opening timing can be specified by detecting the timing at which the intensity of the frequency spectrum near the valve-opening detection switching frequency and the intensity of the frequency spectrum near a frequency that is twice the valve-opening detection switching frequency increase. The frequency spectrum SP3 is a frequency spectrum near the valve-opening detection switching frequency, and the frequency spectrum SP4 is a frequency spectrum near the frequency that is twice the valve-opening detection switching frequency.

Next, a description will be given of a procedure for valve-opening time difference detection processing in which the valve-opening timing detection unit 35 of the control IC 27 detects the valve-opening time difference.

Figure 4:
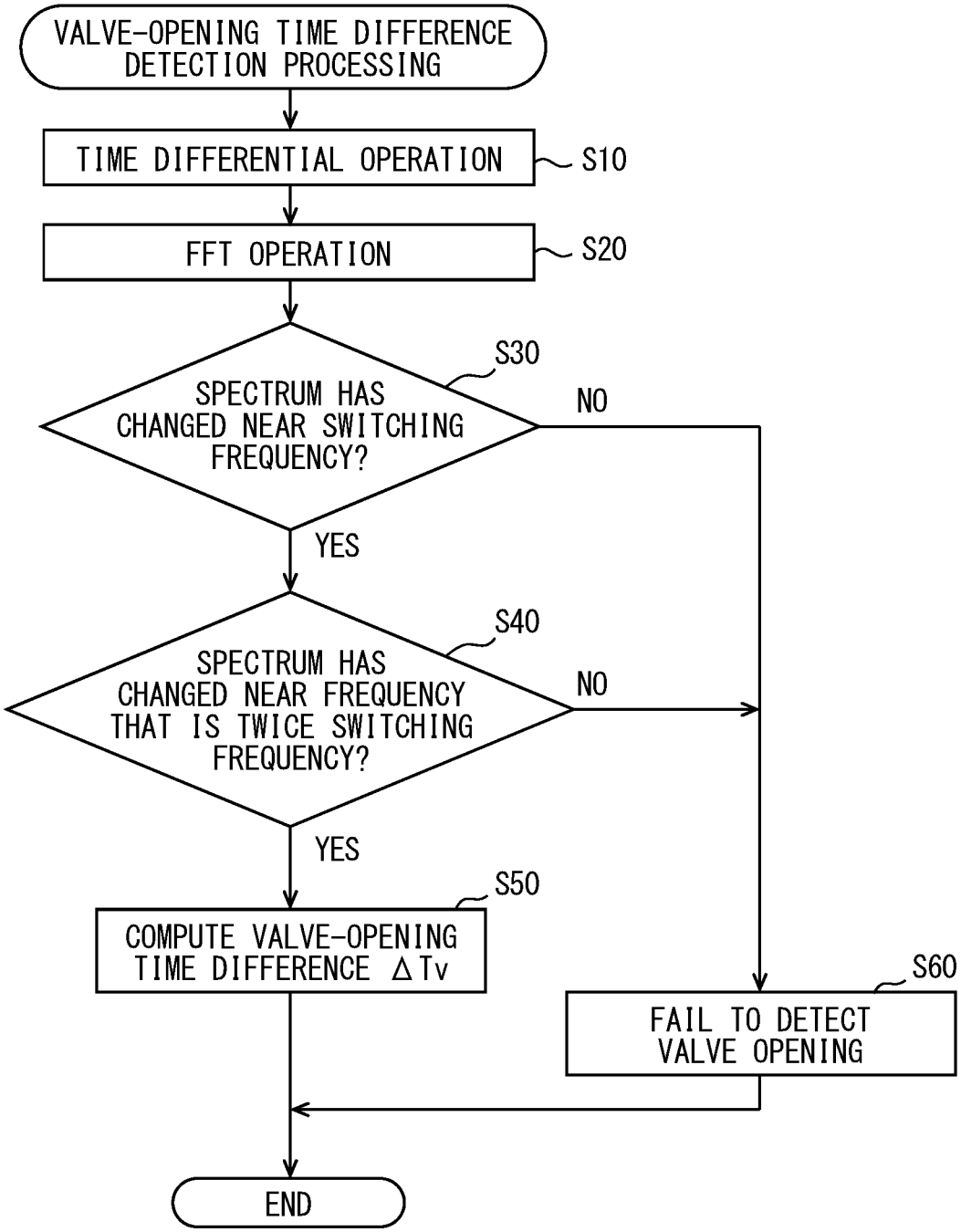
FIG. 4 is a flowchart illustrating valve-opening time difference detection processing according to a first embodiment.

When the valve-opening time difference detection processing is performed, as illustrated in FIG. 4, the differential operation unit 41 of the valve-opening timing detection unit 35 first computes a time differential value (di/dt) obtained by time-differentiating the coil current value in the drive period every time the differential operation time elapses in S10.

In S20, the FFT operation unit 43 of the valve-opening timing detection unit 35 performs the FFT operation on the computed time differential value (di/dt) at every FFT operation time to create a frequency spectrum.

In S30, the valve-opening time difference computation unit 45 of the valve-opening timing detection unit 35 determines whether or not the intensity of the frequency spectrum near the valve-opening detection switching frequency has changed. Specifically, for example, the valve-opening time difference computation unit 45 determines whether or not there has been a change having the maximum value in the frequency spectrum near the valve-opening detection switching frequency. In FIG. 3, the maximum value of the frequency spectrum near the valve-opening detection switching frequency is a point P1 of the frequency spectrum SP3.

Here, when the intensity of the frequency spectrum near the valve-opening detection switching frequency changes, the valve-opening time difference computation unit 45 determines whether or not the intensity of the frequency spectrum near a frequency that is twice the valve-opening detection switching frequency has changed in S40. Specifically, for example, the valve-opening time difference computation unit 45 determines whether or not there is a change having the maximum value in the frequency spectrum near the frequency that is twice the valve-opening detection switching frequency. In FIG. 3, the maximum value of the frequency spectrum near the frequency that is twice the valve-opening detection switching frequency is a point P2 of the frequency spectrum SP4.

Here, when the intensity of the frequency spectrum near the frequency that is twice the valve-opening detection switching frequency changes, the valve-opening time difference computation unit 45 computes a valve-opening time difference ΔTv in S50. Specifically, the valve-opening time difference computation unit 45 detects the detected valve-opening timing based on, for example, the time point of the rising start and the time point of the falling end of the intensity in the change having the maximum value in the frequency spectrum near the valve-opening detection switching frequency. In FIG. 3, the time point of the rising start in the frequency spectrum near the valve-opening detection switching frequency is a point P3 of the frequency spectrum SP3. The time point of the falling end in the frequency spectrum near the valve-opening detection switching frequency is a point P4 of the frequency spectrum SP3.

The valve-opening time difference computation unit 45 computes a subtraction value obtained by subtracting the detected valve-opening timing from the estimated valve-opening timing as the valve-opening time difference ΔTv. Further, the valve-opening time difference computation unit 45 outputs valve-opening detection information indicating the computed valve-opening time difference ΔTv to the microcomputer 25.

When the processing of S50 ends, the valve-opening timing detection unit 35 ends the valve-opening time difference detection processing.

When the intensity of the frequency spectrum near the valve-opening detection switching frequency has not changed in S30, the valve-opening time difference computation unit 45 proceeds to S60. When the intensity of the frequency spectrum near the frequency that is twice the valve-opening detection switching frequency has not changed in S40, the valve-opening time difference computation unit 45 proceeds to S60.

When the processing proceeds to S60, the valve-opening time difference computation unit 45 outputs valve-opening detection information, indicating that the valve-opening time difference ΔTv has failed to be computed, to the microcomputer 25 and ends the valve-opening time difference detection processing.

Next, a procedure for correction processing performed by the microcomputer 25 will be described. The correction processing is processing repeatedly performed during the operation of the microcomputer 25.

Figure 5:
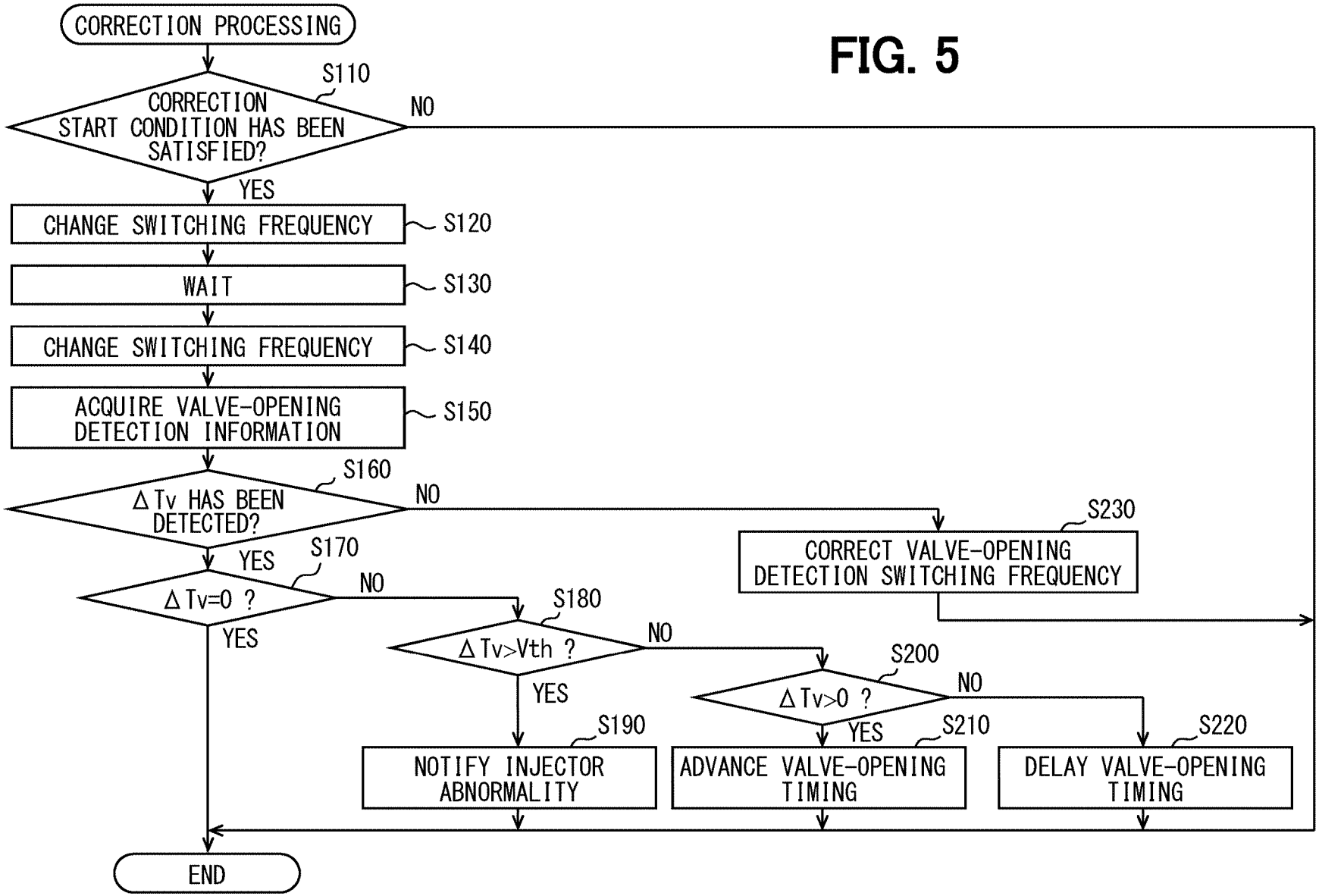
FIG. 5 is a flowchart illustrating correction processing.

When the correction processing is performed, as illustrated in FIG. 5, the CPU 51 of the microcomputer 25 first determines whether or not a preset correction start condition has been satisfied in S110. The correction start condition of the present embodiment is, for example, that a preset correction execution cycle elapses.

Here, when the correction start condition has not been satisfied, the CPU 51 ends the correction processing. On the other hand, when the correction start condition has been satisfied, in S120, the CPU 51 changes the switching frequency for repeatedly switching the on-state and the off-state of the transistors T11, T12 in the first and second constant current control from a normal switching frequency to the valve-opening detection switching frequency. The normal switching frequency is a frequency for repeatedly switching the on-state and the off-state of the transistors T11, T12 in the first and second constant current control except for a state where the valve-opening timing is detected.

Figure 6:
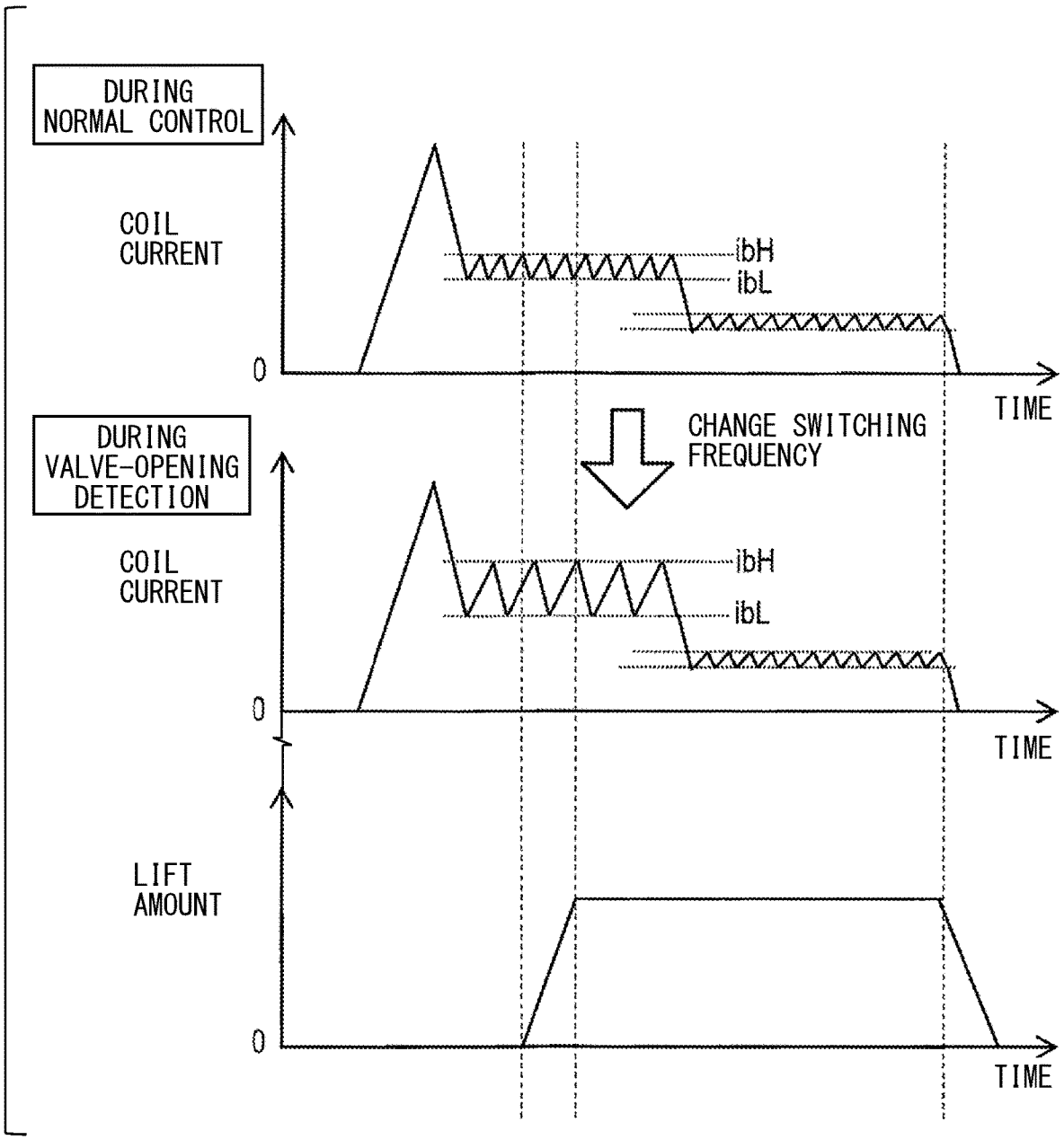
FIG. 6 is a diagram illustrating a method for changing a switching frequency.

Specifically, as illustrated in FIG. 6, the CPU 51 changes the switching frequency by changing the first lower threshold value ibL and the first upper threshold value ibH.

Next, as illustrated in FIG. 5, in S130, the CPU 51 waits until the energization of the injector 2 ends after the energization of the injector 2 is started. Specifically, the CPU 51 waits until the injection command signal changes from low to high and further changes from high to low.

Next, in S140, the CPU 51 changes the switching frequency from the valve-opening detection switching frequency to the normal switching frequency. Further, in S150, the CPU 51 acquires valve-opening detection information from the control IC 27.

In S160, the CPU 51 determines whether or not the valve-opening time difference ΔTv has been detected based on the acquired valve-opening detection information. Specifically, when the valve-opening detection information indicates the valve-opening time difference ΔTv, the CPU 51 determines that the valve-opening time difference ΔTv has been detected.

Here, when the valve-opening time difference ΔTv can be detected, the CPU 51 determines whether or not the valve-opening time difference ΔTv is equal to 0 in S170. When the valve-opening time difference ΔTv is equal to 0, the CPU 51 ends the correction processing.

On the other hand, when the valve-opening time difference ΔTv is not equal to 0, the CPU 51 determines whether or not the valve-opening time difference ΔTv is larger than a preset abnormality detection threshold value Vth in S180.

Here, when the valve-opening time difference ΔTv is larger than the abnormality detection threshold value Vth, the CPU 51 outputs an injector abnormality notification indicating that an abnormality has occurred in the injector 2 in S190, and ends the correction processing.

On the other hand, when the valve-opening time difference ΔTv is less than the abnormality detection threshold value Vth, the CPU 51 determines whether or not the valve-opening time difference ΔTv is larger than 0 in S200. Here, when the valve-opening time difference ΔTv is larger than 0, the CPU 51 advances the valve-opening timing in accordance with the valve-opening time difference ΔTv in S210, and ends the correction processing. A specific method for advancing the valve-opening timing will be described later.

On the other hand, when the valve-opening time difference ΔTv is not larger than 0, the CPU 51 determines that the valve-opening time difference ΔTv is smaller than 0, delays the valve-opening timing in accordance with the valve-opening time difference ΔTv in S220, and ends the correction processing. A specific method for delaying the valve-opening timing will be described later.

When the valve-opening time difference ΔTv fails to be detected in S160, the CPU 51 corrects the valve-opening detection switching frequency in S230, and ends the correction processing. A specific method for correcting the valve-opening detection switching frequency will be described later.

Next, a specific method for changing the valve-opening timing will be described.

First, the valve-opening timing can be advanced by advancing the timing at which the injection command signal is changed from low to high. In other words, the valve-opening timing can be delayed by delaying the timing at which the injection command signal is changed from low to high.

Figure 7:
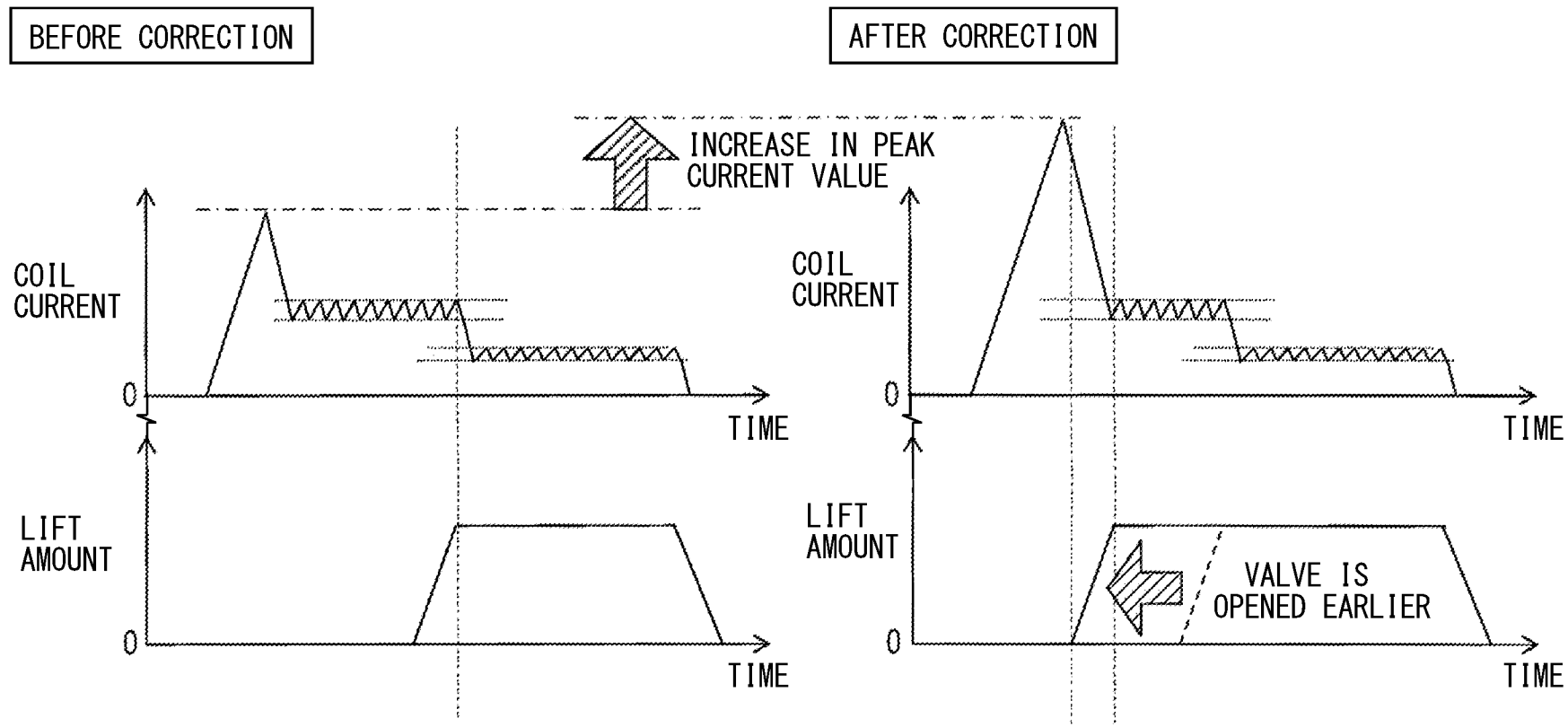
FIG. 7 is a diagram illustrating that the valve-opening timing is advanced due to an increase in peak current value.

As illustrated in FIG. 7, by increasing the peak current value, a suction force to the nozzle needle increases, and the valve-opening timing can be advanced. In other words, the valve-opening timing can be delayed by reducing the peak current value.

Figure 8:
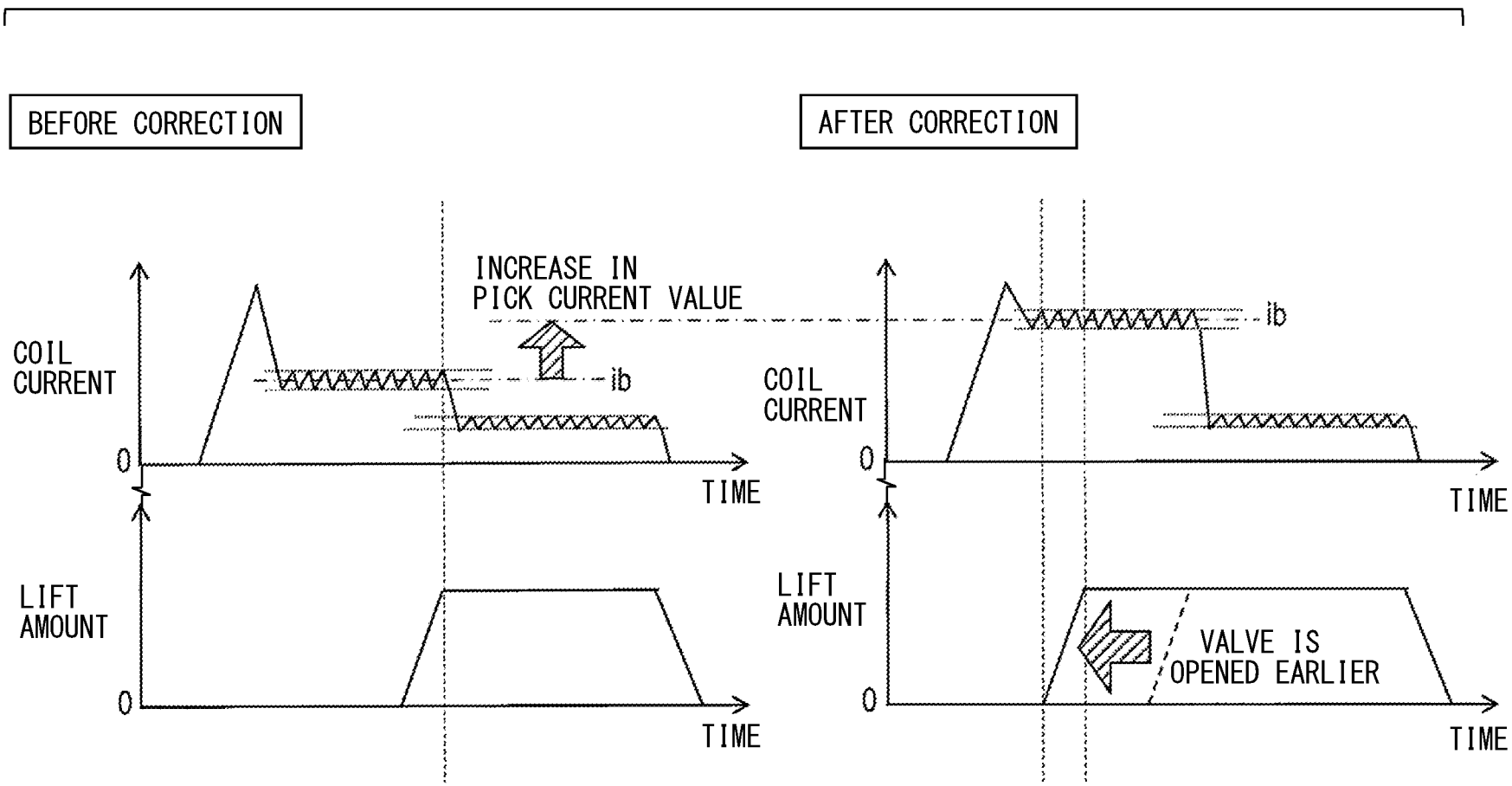
FIG. 8 is a diagram illustrating that the valve-opening timing is advanced due to an increase in pick current value.

As illustrated in FIG. 8, by increasing the first constant value ib of the pick current, the suction force to the nozzle needle increases, and the valve-opening timing can be advanced. In other words, the valve-opening timing can be delayed by decreasing the first constant value ib of the pick current.

Figure 9:
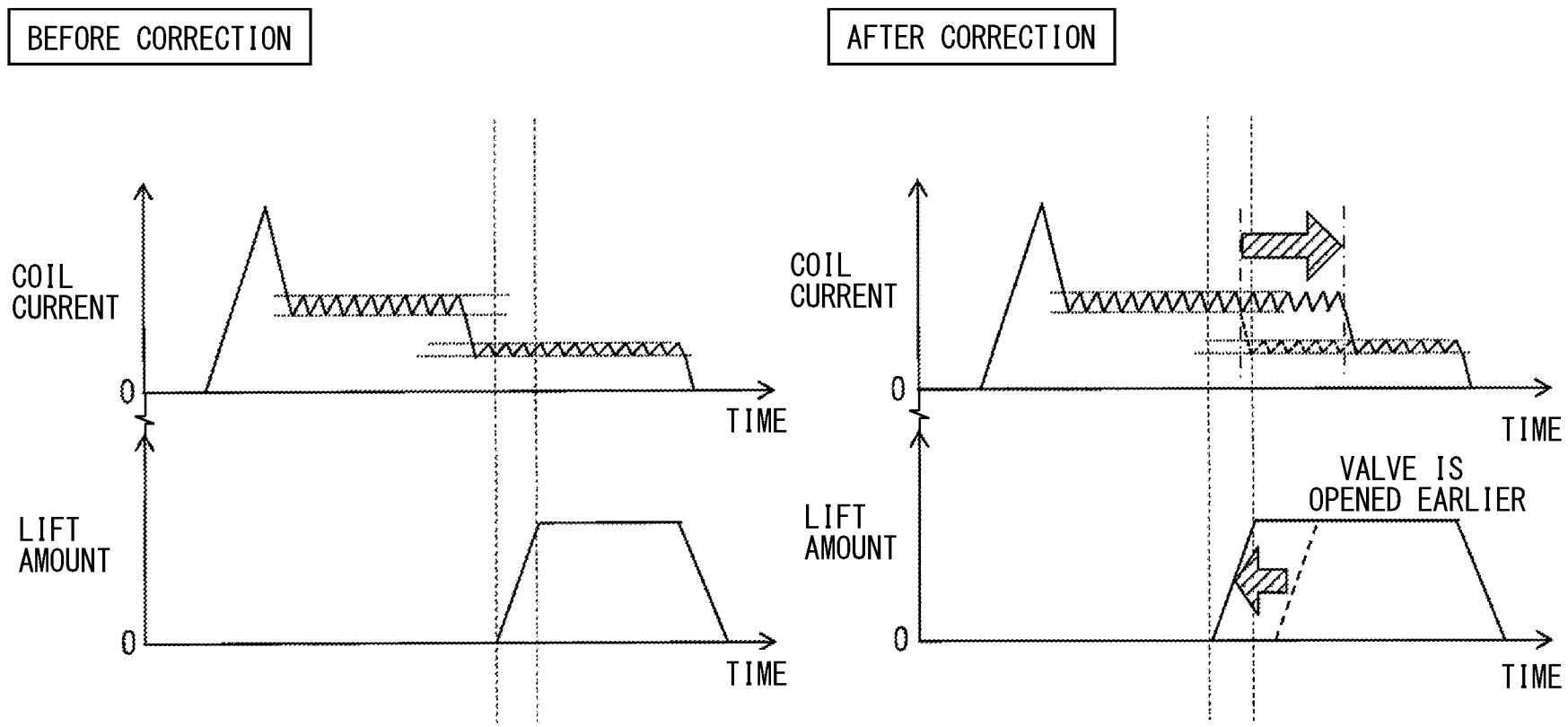
FIG. 9 is a diagram illustrating that the valve-opening timing is advanced by extending a period during which a pick current is allowed to flow.

As illustrated in FIG. 9, by extending the period during which the pick current is allowed to flow, the suction force to the nozzle needle increases, and the valve-opening timing can be advanced. In other words, the valve-opening timing can be delayed by shortening the period during which the pick current is allowed to flow. However, the drive period remains unchanged. That is, the microcomputer 25 changes the ratio of the pick current control period for performing the first constant current control and the ratio of the hold current control period for performing the second constant current control to the length of the injection command signal.

Figure 10:
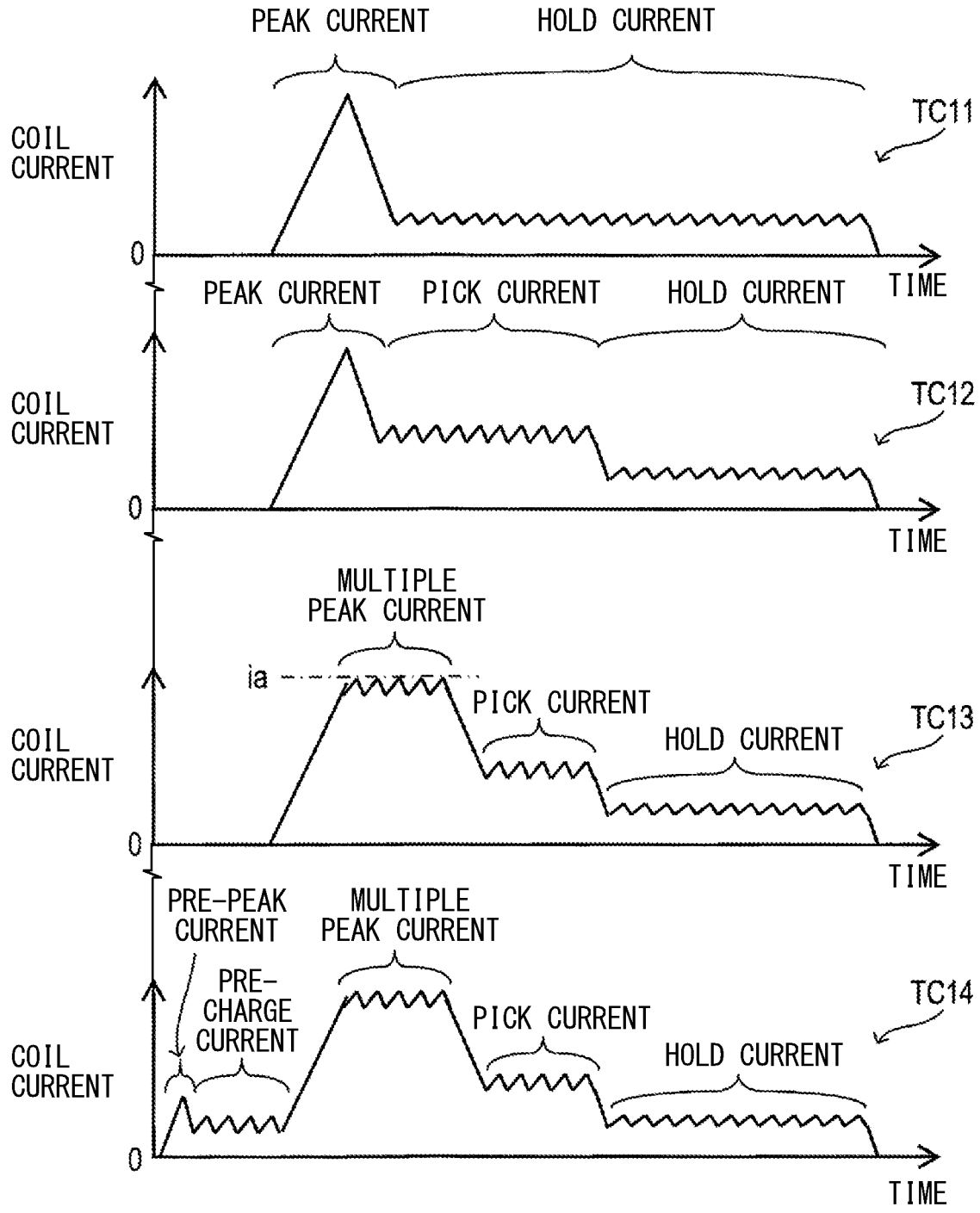
FIG. 10 is a diagram illustrating addition and deletion of a current control period.

As illustrated in a timing chart TC11 of FIG. 10, the valve-opening timing can be delayed by deleting the pick current control period during which the pick current is allowed to flow and changing the deleted pick current control period to the hold current control period during which the hold current is allowed to flow.

As illustrated in the timing chart TC12 of FIG. 10, the valve-opening timing can be advanced by adding the pick current control period to the timing chart TC11 of FIG. 10.

As illustrated in a timing chart TC13 of FIG. 10, the valve-opening timing can be advanced by deleting the peak current control period during which the peak current is allowed to flow and adding a multiple peak current control period during which a multiple peak current is allowed to flow, with many peaks generated by vibration of the coil current value near the target peak value ia.

As illustrated in the timing chart TC14 of FIG. 10, the valve-opening timing can be advanced by adding a pre-peak current control period during which a pre-peak current having a peak value smaller than that of the peak current is allowed to flow and adding a pre-charge current control period during which a pre-charge current, with a coil current value oscillating near a constant value smaller than the peak value of the pre-peak current, is allowed to flow before the multiple peak current control period.

In a case where the valve-opening correction is performed only by changing the peak current and the pick current, the peak current and the pick current are each pulled up to a high current value, which leads to an increase in size or cost of peripheral electronic components (e.g., MOSFET, diode, etc.). However, as illustrated in FIG. 10, the valve opening is corrected by adding or deleting the pick current control period, the hold current control period, and the multiple peak current control period, so that it is possible to expand a range in which the valve-opening timing can be corrected without changing peripheral electronic components.

Figure 11:
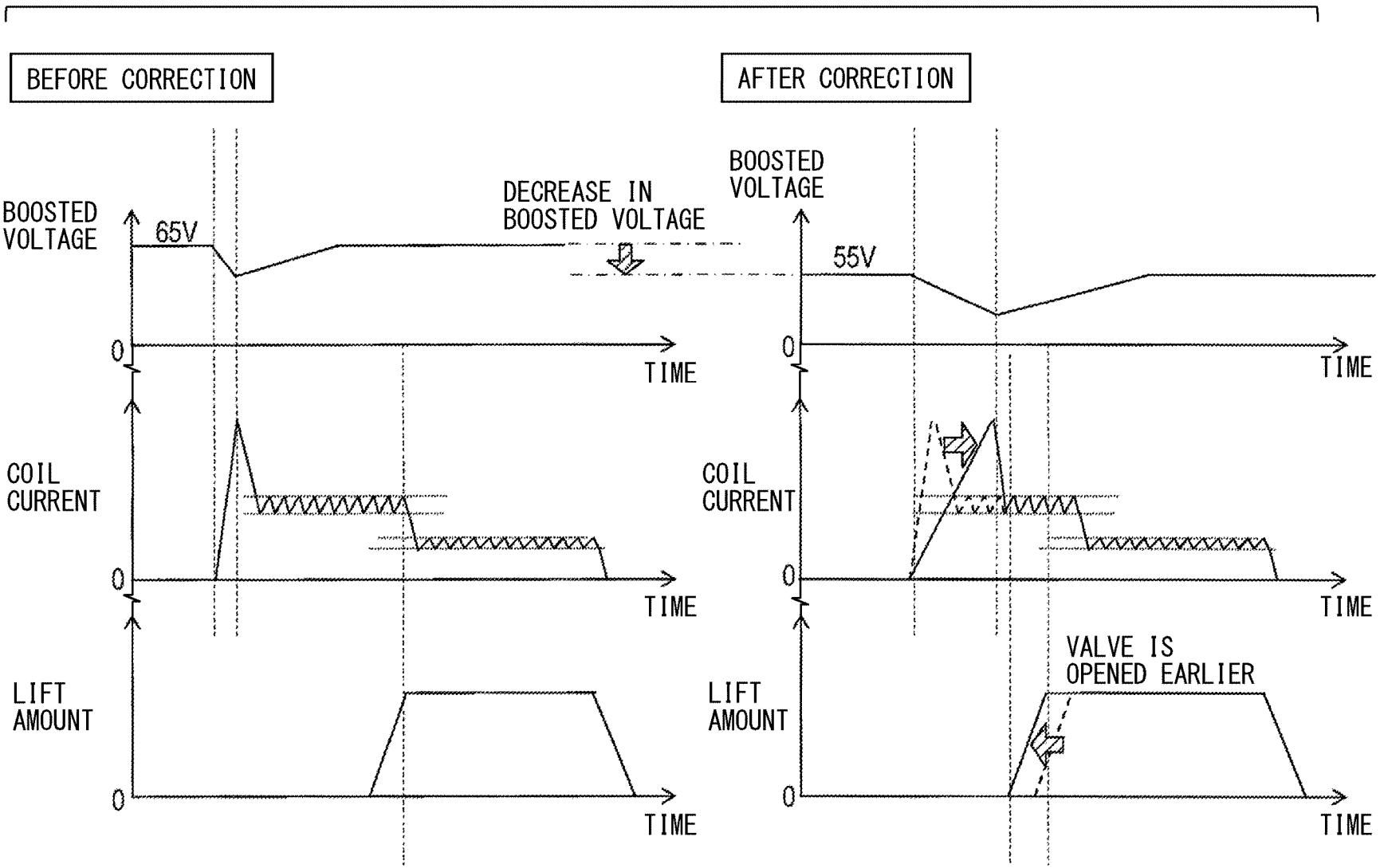
FIG. 11 is a diagram illustrating that the valve-opening timing is advanced due to a decrease in boosted voltage.

As illustrated in FIG. 11, by decreasing a boosted voltage VC, the slope of the peak current can be decreased, and the peak current control period can be lengthened. Thereby, the suction force to the nozzle needle increases, and the valve-opening timing can be advanced. In other words, the valve-opening timing can be delayed by increasing the boosted voltage VC.

Next, the abnormality of the injector 2 will be described.

Figure 12:
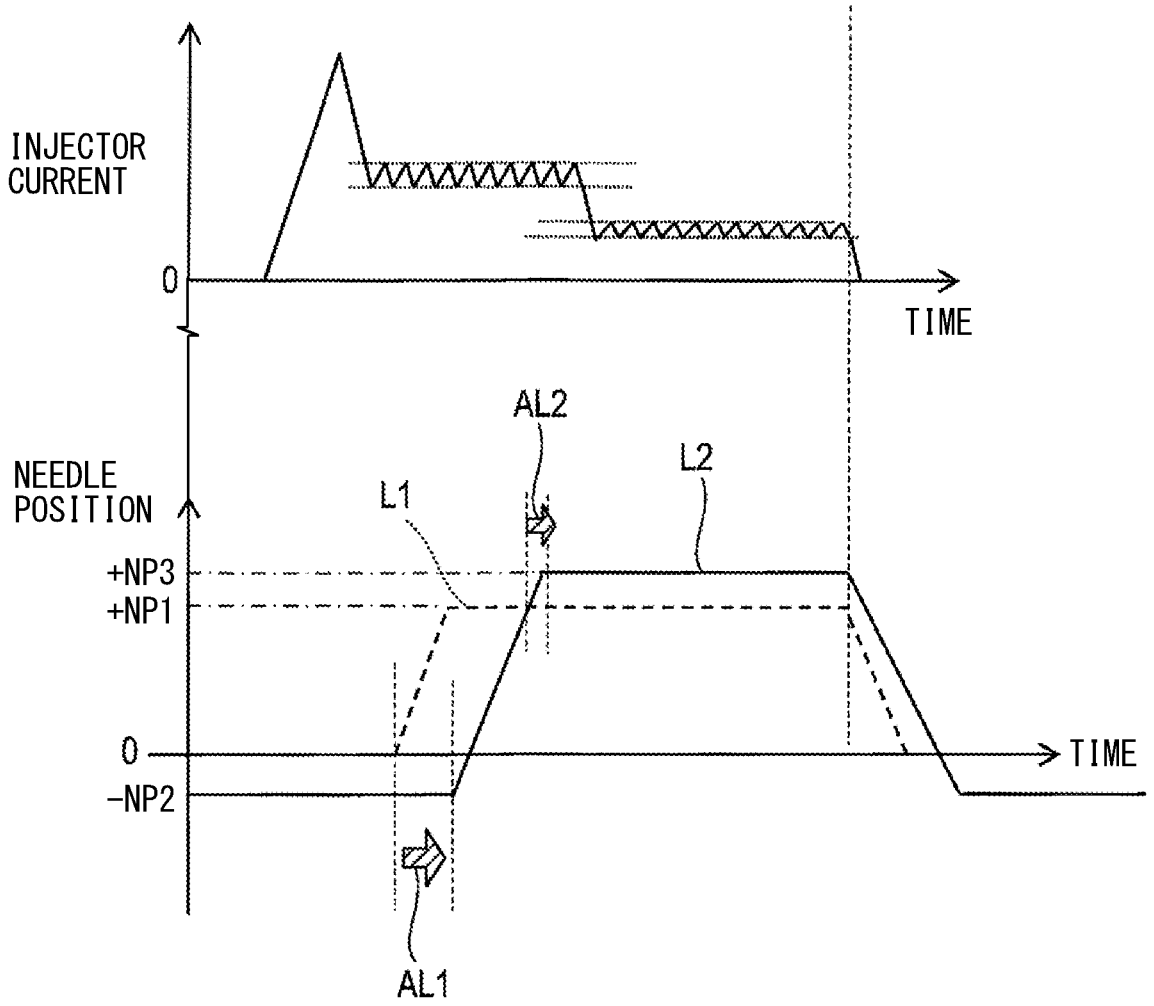
FIG. 12 is a diagram for explaining an abnormality of an injector.

FIG. 12 is a diagram illustrating a time change of the nozzle needle position (hereinafter, needle position) in each of a normal state and an abnormal state in association with a time change of the coil current. A line L1 indicates the time change of the needle position in the normal state. A line L2 indicates the time change of the needle position in the abnormal state.

As illustrated in FIG. 12, in the normal state, the needle position at the time of valve closing is 0, and the needle position at the completion of valve opening is +NP1.

However, when the clearance is enlarged due to the wear of a seat, the needle position when the valve is closed changes from 0 to −NP2 as indicated by line L2. As a result, as indicated by an arrow AL1, the valve-opening start time is delayed.

Further, due to the wear of an abutment portion on the valve opening side, the needle position at the completion of valve opening changes from +NP1 to +NP3, and the lift amount until the valve opening is completed increases. As a result, as indicated by an arrow AL2, the valve-opening completion time is delayed.

Therefore, in S180, the CPU 51 determines the occurrence of an abnormality based on whether or not the valve-opening time difference ΔTv is larger than the abnormality detection threshold value Vth.

Next, the correction of the valve-opening detection switching frequency will be described.

Figure 13:
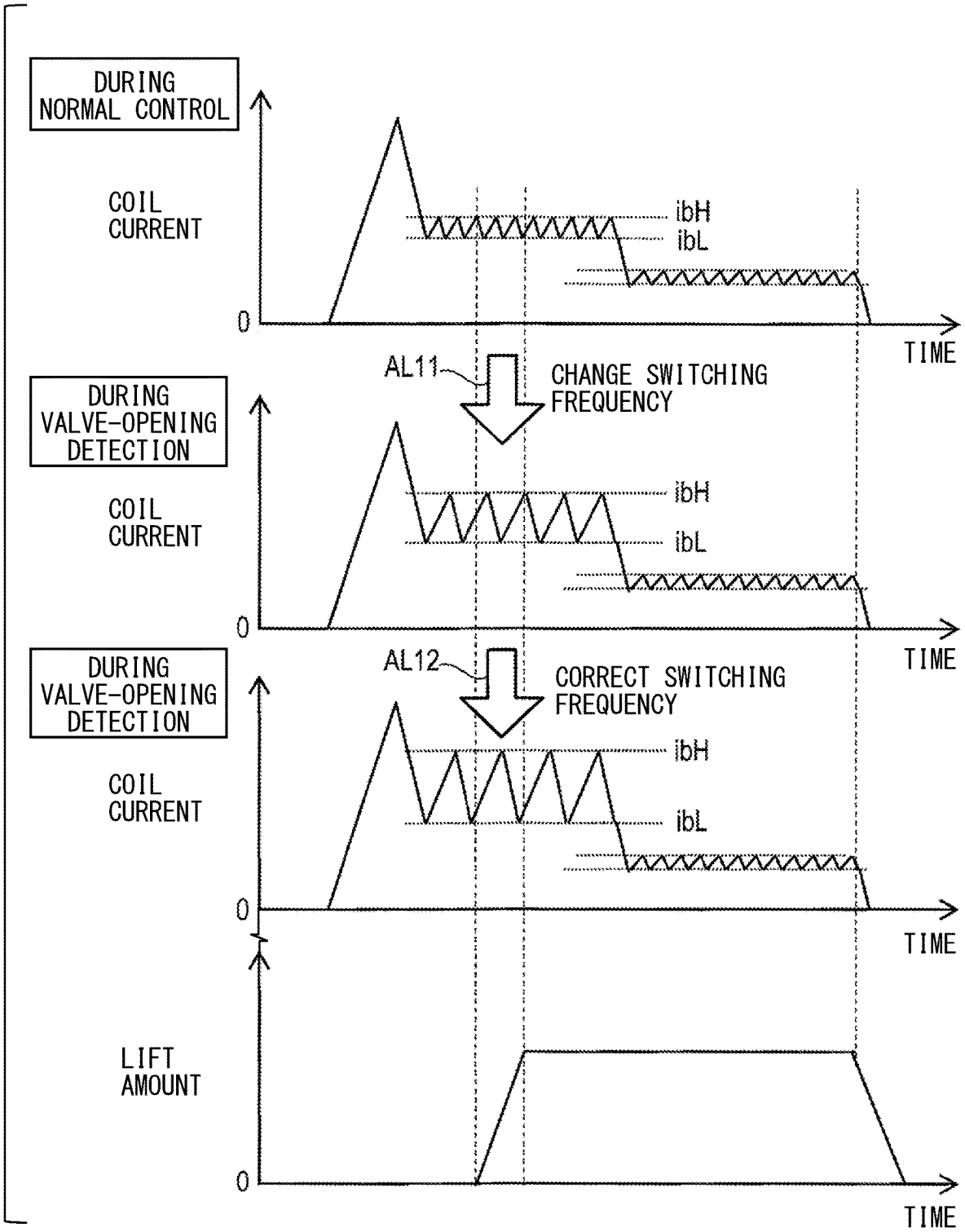
FIG. 13 is a diagram illustrating a method for correcting a valve-opening detection switching frequency.

As illustrated in FIG. 13, at the time of detecting the valve-opening timing, the switching frequency is changed from the normal switching frequency to the valve-opening detection switching frequency by changing the first lower threshold value ibL and the first upper threshold value ibH. An arrow AL11 indicates a change from the normal switching frequency to the valve-opening detection switching frequency.

When the valve-opening time difference ΔTv fails to be detected, the valve-opening detection switching frequency is corrected by further changing the first lower threshold value ibL and the first upper threshold value ibH. An arrow AL12 indicates the correction of the valve-opening detection switching frequency.

The ECU 1 configured as described above is a fuel injection control device that controls the energization of the coil 2*a* of the injector 2 and includes the energization control unit 33, the current detecting resistor R10, the valve-opening timing detection unit 35, and the valve-opening correction unit 57.

The energization control unit 33 performs the first constant current control by repeatedly switching between the on-state and the off-state of the transistor T12 provided in the energization path in the drive period during which the coil 2*a* is energized to drive the injector 2, and controls the valve opening of the injector 2.

The current detecting resistor R10 detects a coil current flowing through the coil 2*a*.

The valve-opening timing detection unit 35 detects the valve-opening timing of the injector 2 based on changes in the two frequency spectrums of the coil current in the pick current control period during which the first constant current control is performed.

The valve-opening correction unit 57 corrects the valve opening by the injector 2 based on the detection result of the valve-opening timing detection unit 35.

As described above, the ECU 1 can detect the valve-opening timing of the injector 2 generated during the first constant current control in a case where the injector 2 is opened by performing the first constant current control by use of the boosted voltage VC obtained by boosting the battery voltage VB of the in-vehicle battery. Thus, the ECU 1 can specify the valve-opening timing when the injector 2 is controlled by allowing a large current to flow. Further, the ECU 1 can correct variations between injector individuals (e.g., initial variation, disturbance of a fuel temperature or the like, and deterioration associated with long-term use).

Moreover, since the ECU 1 detects the valve-opening timing based on the changes in the two frequency spectra of the coil current, it is not necessary to provide a sensor circuit inside the injector 2 for detecting the valve-opening timing, and the configuration of the injector 2 can be simplified.

In addition, the valve-opening timing detection unit 35 detects the valve-opening timing when the changes in the two frequency spectra satisfy a preset valve-opening detection condition during the pick current control period.

The two frequency spectra are a frequency spectrum (hereinafter, first frequency spectrum) at a first frequency near a valve-opening detection switching frequency for repeatedly switching the on-state and the off-state of the transistor T12 in the pick current control period, and a frequency spectrum (hereinafter, second frequency spectrum) at a second frequency near a frequency that is twice the first frequency. The first and second frequency spectra are created by performing FFT operation on a time differential value, obtained by differentiating the coil current value at every preset differential operation time, at every preset FFT operation time. As a result, the ECU 1 can detect the valve-opening timing during the constant current control.

The valve-opening detection condition in the present embodiment is that a change is made to have the maximum value in the intensities of the first and second frequency spectra.

When the valve-opening timing detection unit 35 starts detecting the valve-opening timing, the microcomputer 25 switches the switching frequency from the normal switching frequency to the valve-opening detection switching frequency. As a result, the ECU 1 can arbitrarily set the switching frequency in the first and second constant current control except for a state where the valve-opening timing is detected. Hence the ECU 1 can reduce the switching losses of the transistors T11, T12 to take measures against heat or change the emission noise frequency to improve electromagnetic compatibility (EMC) performance.

When the valve-opening timing detection unit 35 cannot detect the valve-opening timing, the microcomputer 25 corrects the valve-opening detection switching frequency. Thus, when a switching frequency having high valve-opening detection sensitivity changes with the temperature characteristic of the injector 2 or deterioration due to the long-term use of the injector 2, the ECU 1 can maintain the valve-opening detection sensitivity by changing the switching frequency.

The microcomputer 25 determines whether or not an abnormality has occurred in the injector 2 based on the detection result of the valve-opening timing detection unit 35. When determining that an abnormality has occurred in the injector 2, the microcomputer 25 outputs an injector abnormality notification indicating the occurrence of an abnormality. As a result, the ECU 1 can make notification of an appropriate injector replacement time, and the product life of the injector 2 can be used up, so that the replacement frequency of the injector 2 can be reduced.

In the embodiment described above, the ECU 1 corresponds to a fuel injection control device, the injector 2 corresponds to a fuel injection valve, the current detecting resistor R10 corresponds to a current detection unit, the valve-opening timing detection unit 35 corresponds to a valve-opening detection unit, and S170, S200 to S220 correspond to processing as a valve-opening correction unit.

The transistors T11, T12 correspond to upstream switches, and the first constant current control and the second constant current control correspond to constant current control.

The time differential value (di/dt) corresponds to a current-related parameter, the FFT operation time corresponds to a first predetermined time, the differential operation time corresponds to a second predetermined time, the frequency spectrum SP3 corresponds to a first frequency spectrum, and the frequency spectrum SP4 corresponds to a second frequency spectrum.

S120 corresponds to processing as a frequency switching unit, S230 corresponds to processing as a switching correction unit, and the first constant value ib corresponds to an effective value of a constant current.

The pick current and the hold current correspond to constant currents, the battery voltage VB and the boosted voltage VC correspond to energizing voltages, S180 corresponds to processing as an abnormality determination unit, and S190 corresponds to processing as an abnormality notification unit.

Second Embodiment

Hereinafter, a second embodiment of the present disclosure will be described with reference to the drawings. In the second embodiment, parts different from the first embodiment will be described. Common configurations are denoted by the same reference numerals.

The ECU 1 of the second embodiment is different from that of the first embodiment in that the valve-opening time difference detection processing is changed.

The valve-opening time difference detection processing of the second embodiment is different from that of the first embodiment in that the processing of S45 is added.

Figure 14:
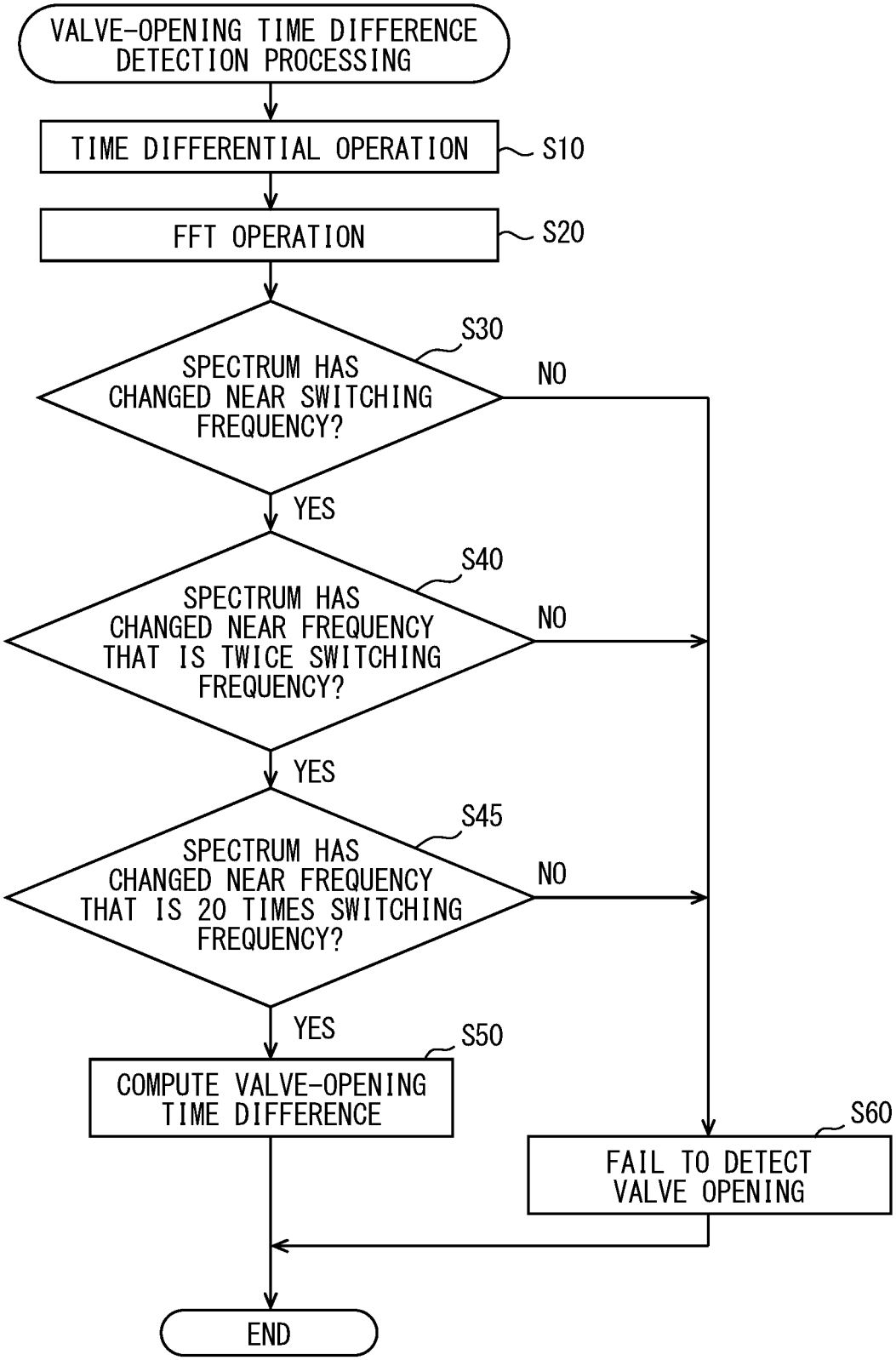
FIG. 14 is a flowchart illustrating valve-opening time difference detection processing according to a second embodiment.

That is, as illustrated in FIG. 14, when the intensity of the frequency spectrum near the frequency that is twice the valve-opening detection switching frequency changes in S40, the valve-opening time difference computation unit 45 determines whether or not the intensity of a frequency spectrum near a frequency that is 20 times the valve-opening detection switching frequency has changed in S45. Specifically, for example, the valve-opening time difference computation unit 45 determines whether or not the vibration is large at the valve-opening detection switching frequency in a period near a time point at which the intensity of the frequency spectrum near the frequency that is 20 times the valve-opening detection switching frequency becomes the maximum value in the frequency spectrum near the valve-opening detection switching frequency. "Whether or not the vibration is large at the valve-opening detection switching frequency" in S45 is valid regardless of whether or not to be used for determining whether or not the valve-opening timing has been detected.

When the intensity of the frequency spectrum near the frequency that is 20 times the valve-opening detection switching frequency changes, the valve-opening time difference computation unit 45 proceeds to S50. On the other hand, when the intensity of the frequency spectrum near the frequency that is 20 times the valve-opening detection switching frequency has not changed, the valve-opening time difference computation unit 45 proceeds to S60.

The ECU 1 thus configured includes the energization control unit 33, the current detecting resistor R10, the valve-opening timing detection unit 35, and the valve-opening correction unit 57. The valve-opening timing detection unit 35 detects the valve-opening timing of the injector 2 based on changes in three frequency spectrums of the coil current in the pick current control period during which the first constant current control is performed.

Thus, similarly to the ECU 1 of the first embodiment, the ECU 1 of the second embodiment can specify the valve-opening timing when the injector 2 is controlled by flowing a large current.

Although one embodiment of the present disclosure has been described above, the present disclosure is not limited to the above embodiment, and various modifications can be made.

(First Modification)

For example, in the embodiment described above, the mode has been described where the injector 2 injects liquid fuel into a gasoline engine or a diesel engine. However, the fuel is not limited to liquid fuel, and the present disclosure may be applied to an injector that injects gaseous fuel such as hydrogen.

(Second Modification)

In the embodiment described above, the mode has been described where the FFT operation is performed on the time differential value of the coil current value to create the frequency spectrum. However, the FFT operation may be performed on the coil current value to create the frequency spectrum.

(Third Modification)

In the first embodiment, the mode has been described where the valve-opening timing is detected using the frequency spectrum near the valve-opening detection switching frequency and the frequency spectrum near the frequency that is twice the valve-opening detection switching frequency. However, a frequency spectrum near a frequency that is a multiplication of the valve-opening detection switching frequency may be used. This is because the time change of the time differential value of the coil current value has a waveform that repeats a change steeper than the sine wave of the valve-opening detection switching frequency.

(Fourth Modification)

In the embodiment described above, the mode has been described where the valve-opening timing is advanced or delayed in accordance with the valve-opening time difference ΔTv. However, the length of the injection command signal may be increased or decreased in accordance with the valve-opening time difference ΔTv. Specifically, when the valve-opening time difference ΔTv is larger than 0, the length of the injection command signal may be lengthened in accordance with the valve-opening time difference ΔTv, and when the valve-opening time difference ΔTv is smaller than 0, the length of the injection command signal may be shortened in accordance with the valve-opening time difference ΔTv. As a result, the fuel injection amount can be kept constant regardless of the valve-opening timing.

(Fifth Modification)

In the embodiment described above, the mode has been described where the control IC 27 includes the valve-opening timing detection unit 35, and the microcomputer 25 performs the correction processing. However, the processing achieved by the valve-opening timing detection unit 35 may be performed by the microcomputer 25, or the correction processing performed by the microcomputer 25 may be achieved by using the control IC 27.

(Sixth Modification)

In the above embodiment, the mode has been described where the on-state and the off-state of the transistor T12 are repeatedly switched in the first constant current control, but the on-state and the off-state of the transistor T11 may be repeatedly switched in the first constant current control.

The ECU 1 and the technique thereof described in the present disclosure may be achieved by a dedicated computer provided by configuring a processor and a memory programmed to execute one or a plurality of functions embodied by a computer program. Alternatively, the ECU 1 and the technique according to the present disclosure may be achieved by a dedicated computer provided by constituting a processor with one or more dedicated hardware logic circuits. Alternatively, the ECU 1 and the technique thereof according to the present disclosure may be achieved using one or a plurality of dedicated computers constituted by a combination of the processor and the memory programmed to execute one or more functions and the processor with one or more hardware logic circuits. The computer program may be stored in a computer-readable non-transitional tangible recording medium as an instruction to be executed by the computer. The technique for achieving the function of each unit included in the ECU 1 does not necessarily include software, and all the functions may be achieved using one or a plurality of pieces of hardware.

A plurality of functions of one component in the above embodiment may be achieved by a plurality of components, or one function of one component may be achieved by a plurality of components. A plurality of functions of a plurality of components may be achieved by one component, or one function achieved by a plurality of components may be achieved by one component. A part of the configuration of the above embodiment may be omitted. At least a part of the configuration of the above embodiment may be added to or replaced with the configuration of another above embodiment.

What is claim is:

1. A fuel injection control device configured to control energization of a coil of a fuel injection valve, the fuel injection control device comprising:

an energization control unit configured to, in a drive period in which the coil is energized by causing a coil current to flow through the coil to drive the fuel injection valve, perform a constant current control by repeatedly switching between an on-state and an off-state of at least one upstream switch provided in an energization path to control opening of the fuel injection valve;

a current detection unit configured to detect the coil current flowing through the coil;

a valve-opening detection unit configured to detect valve-opening timing of the fuel injection valve based on a change in values of at least one frequency spectrum of the coil current in a constant current control period in which the constant current control is performed; and a valve-opening correction unit configured to correct valve opening of the fuel injection valve based on a detection result of the valve-opening detection unit, wherein the at least one frequency spectrum includes a plurality of frequency spectra, the valve-opening detection unit is configured to detect the valve-opening timing when a change in values of the plurality of frequency spectra satisfies a valve-opening detection condition, which is set in advance, in the constant current control period, the plurality of frequency spectra includes a first frequency spectrum at a first frequency near a switching frequency, at which the at least one upstream switch is repeatedly switched between the on-state and the off-state in the constant current control, and a second frequency spectrum at a second frequency near a frequency, which is a multiplication of the first frequency, and the valve-opening detection unit is configured to detect the valve-opening timing when a change in values of each of the first frequency spectrum and the second frequency spectrum satisfies the valve-opening detection condition in the constant current control period.

2. The fuel injection control device according to claim 1, wherein the frequency spectrum is created by performing fast Fourier transform (FFT) operation on a current-related parameter, which is related to a coil current value of the coil current, at every first predetermined time, which is set in advance.

3. The fuel injection control device according to claim 2, wherein the current-related parameter is a time differential value obtained by differentiating the coil current value at every second predetermined time, which is set in advance.

4. The fuel injection control device according to claim 1, further comprising:

a frequency switching unit configured to, when the valve-opening detection unit starts detection of the valve-opening timing, switch a switching frequency, at which the at least one upstream switch is repeatedly switched between the on-state and the off-state, in the constant current control from a normal switching frequency, which is a switching frequency when the valve-opening timing is not detected, to a valve-opening detection switching frequency, which is a switching frequency when the valve-opening timing is detected.

5. The fuel injection control device according to claim 4, further comprising:

a switching correction unit configured to correct the valve-opening detection switching frequency when the valve-opening detection unit fails to detect the valve-opening timing.

6. The fuel injection control device according to claim 1, further comprising:

a control IC that includes at least the valve-opening detection unit; and at least one microcomputer that includes at least the valve-opening correction unit, wherein the control IC is configured to output, to the at least one microcomputer, valve-opening detection information indicating a detection result of the valve-opening detection unit.

7. The fuel injection control device according to claim 6, wherein the at least one microcomputer includes at least the valve-opening detection unit and the valve-opening correction unit.

8. The fuel injection control device according to claim 1, wherein the valve-opening correction unit is configured to correct the valve opening by changing an output timing of an injection command signal that commands fuel injection start timing of the fuel injection valve.

9. The fuel injection control device according to claim 1, wherein the valve-opening correction unit is configured to correct the valve opening by changing a length of an injection command signal that commands fuel injection start timing of the fuel injection valve.

10. The fuel injection control device according to claim 1, wherein the valve-opening correction unit is configured to correct the valve opening by changing a value of a peak current.

11. The fuel injection control device according to claim 1, wherein the valve-opening correction unit is configured to correct the valve opening by changing an effective value of a constant current in the constant current control.

12. The fuel injection control device according to claim 1, wherein the constant current control includes a first constant current control to cause, as a constant current in the constant current control, a first constant current to flow through the coil and a second constant current control to cause, as the constant current, a second constant current, which is smaller in a current value than the first constant current, to flow through the coil, and the valve-opening correction unit is configured to correct the valve opening by changing a ratio of a first constant current control period, in which the first constant current control is performed, and a ratio of a second constant current control period, in which the second constant current control is performed, to a period of an injection command signal that commands fuel injection start timing of the fuel injection valve.

13. The fuel injection control device according to claim 1, wherein the valve-opening correction unit is configured to correct the valve opening by adding or deleting the constant current control period, in which the constant current control is performed, in the control of the energization control unit.

14. The fuel injection control device according to claim 1, wherein an energizing voltage for energizing the coil includes a boosted voltage obtained by boosting a battery voltage of an in-vehicle battery, and the valve-opening correction unit corrects the valve opening by changing the boosted voltage.

15. The fuel injection control device according to claim 1, further comprising:

an abnormality determination unit configured to determine whether an abnormality occurs in the fuel injection valve based on a detection result of the valve-opening detection unit; and an abnormality notification unit configured to notify that an abnormality occurs in the fuel injection valve when the abnormality determination unit determines that an abnormality occurs in the fuel injection valve.

16. The fuel injection control device according to claim 1, wherein the valve-opening detection unit is configured to determine whether a change having a maximum value occurs in the at least one frequency spectrum and on determination that the change having the maximum value occurs in the at least one frequency spectrum, detect the valve-opening timing based on a time point of a rising start and a time point of a falling end of an intensity in the change having the maximum value.

17. The fuel injection control device according to claim 16, wherein the valve-opening detection unit includes a differential operation unit configured to compute a time differential value obtained by time-differentiating the coil current in the drive period every time a differential operation time elapses and an FFT operation unit configured to perform an FFT operation on the time differential value computed by the differential operation unit at every FFT operation time to create the values of the at least one frequency spectrum.

18. The fuel injection control device according to claim 17, wherein the coil is configured to be applied with a voltage that is higher than a battery voltage of a vehicle provided with the fuel injection valve.

19. A fuel injection control device comprising:

at least one processor configured to cause a circuitry to repeatedly switch between an on-state and an off-state of at least one switch in an energization path of a coil of a fuel injection valve to control a coil current, which flows through the coil to drive the fuel injection valve, at a constant value to control opening of the fuel injection valve in a constant current control period;

detect valve-opening timing of the fuel injection valve based on a change in values of at least one frequency spectrum of the coil current in the constant current control period; and correct valve opening of the fuel injection valve based on a detection result of the valve-opening timing, wherein the at least one frequency spectrum includes a plurality of frequency spectra, the at least one processor is configured to detect the valve-opening timing when a change in values of the plurality of frequency spectra satisfies a valve-opening detection condition, which is set in advance, in the constant current control period, the plurality of frequency spectra includes a first frequency spectrum at a first frequency near a switching frequency, at which the at least one upstream switch is repeatedly switched between the on-state and the off-state in the constant current control, and a second frequency spectrum at a second frequency near a frequency, which is a multiplication of the first frequency, and the at least one processor is configured to detect the valve-opening timing when a change in values of each of the first frequency spectrum and the second frequency spectrum satisfies the valve-opening detection condition in the constant current control period.

20. The fuel injection control device according to claim 19, wherein the at least one processor configured to determine whether a change having a maximum value occurs in the at least one frequency spectrum and on determination that the change having the maximum value occurs in the at least one frequency spectrum, detect the valve-opening timing based on a time point of a rising start and a time point of a falling end of an intensity in the change having the maximum value.

21. The fuel injection control device according to claim 20, wherein the at least one processor configured to compute a time differential value obtained by time-differentiating the coil current in a drive period, in which the coil is energized, every time a differential operation time elapses and perform an FFT operation on the computed time differential value at every FFT operation time to create the values of the at least one frequency spectrum.

22. The fuel injection control device according to claim 21, wherein the coil is configured to be applied with a voltage that is higher than a battery voltage of a vehicle provided with the fuel injection valve.

* * * * *